US005117892A

United States Patent [19]

Murray

[11] Patent Number: 5,117,892

[45] Date of Patent: Jun. 2, 1992

[54] WINDOW SHADE TRACK CONSTRUCTION

[76] Inventor: Alan C. Murray, 6319 22nd Northeast, Seattle, Wash. 98115

[21] Appl. No.: 542,467

[22] Filed: Jun. 22, 1990

[51] Int. Cl.[5] ..... E06B 9/56

[52] U.S. Cl. ..... 160/273.1; 160/272; 160/269

[58] Field of Search ..... 160/273.1, 272, 271, 160/269, 270, 201, 133; 52/DIG. 8, 222

[56] References Cited

U.S. PATENT DOCUMENTS

| | | | |
|---|---|---|---|
| 1,485,325 | 2/1924 | Yerly | 160/273.1 X |
| 1,604,054 | 10/1926 | Kuyper | 160/273.1 X |
| 1,934,103 | 11/1933 | Traut | 160/273.1 X |
| 1,978,120 | 10/1934 | Watson | 160/273.1 X |
| 2,247,634 | 7/1941 | Houston | 20/40 |
| 2,871,933 | 2/1959 | Kroger | 160/41 |
| 4,357,978 | 11/1982 | Keller et al. | 160/41 |
| 4,369,827 | 1/1983 | Anderson | 160/41 |
| 4,398,585 | 8/1983 | Marlow | 160/23 R |
| 4,399,855 | 8/1983 | Volfson | 160/41 |
| 4,408,650 | 10/1983 | Verch | 160/121 R |
| 4,499,937 | 2/1985 | Waine et al. | 160/41 |
| 4,649,981 | 3/1987 | Bibeau | 160/120 |

FOREIGN PATENT DOCUMENTS

| | | | |
|---|---|---|---|
| 1020785 | 2/1966 | United Kingdom | 160/273.1 |

*Primary Examiner*—Blair M. Johnson

*Attorney, Agent, or Firm*—Ward Brown; Robert W. Beach

[57] ABSTRACT

Channels having inward-opening grooves are mounted on the upright facing sides of a window frame below the roller of a conventional roll shade. Elongated sealing strips of resilient sheet material have their opposite edge portions rolled or folded inward into abutting relationship and are inserted into the channels. The opposite edge portions of each strip are biased together due to the inherent resiliency of the strip sheet material. The channels and strips capture the side margins of the body of the roll shade to seal the shade to the window frame.

12 Claims, 2 Drawing Sheets

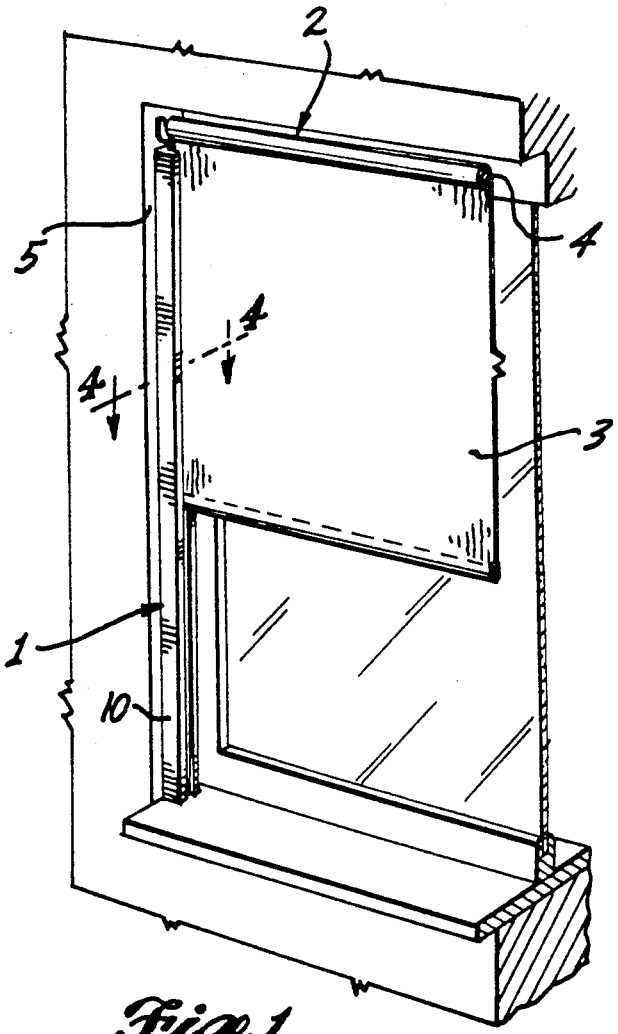
Fig. 1.
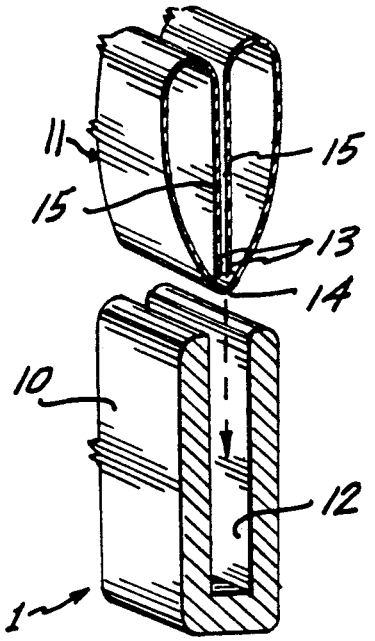
Fig. 2.
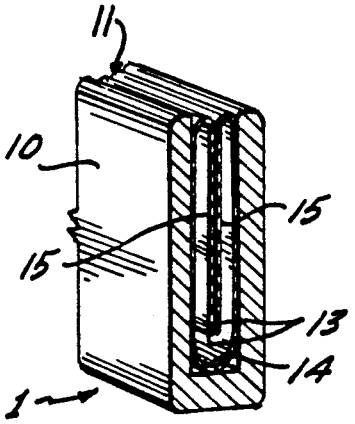
Fig. 3.
Fig. 4.
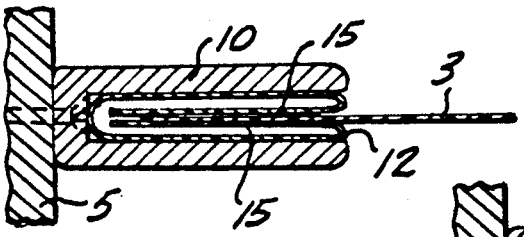
Fig. 5.
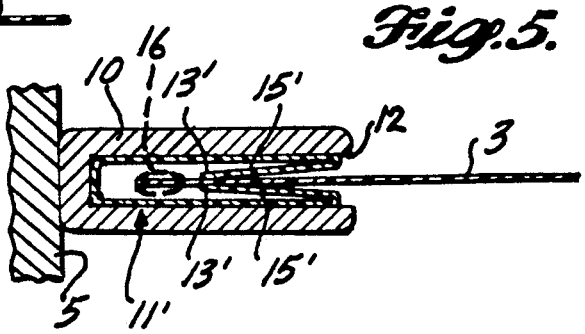

WINDOW SHADE TRACK CONSTRUCTION

BACKGROUND OF THE INVENTION

1.Field of the Invention

The present invention relates to the general field of roll shades for windows and, more specifically, to roll shade installations in which a seal is formed between each side margin of the shade and the adjacent upright side of the window frame.

2. Prior Art

A conventional roll shade consisting of flexible sheet material wound on a roller typically is installed at the inside of a window so that the sheet material can be unwound from the roller to obstruct light passing through the window. When formed of air-impervious material, the shade also has an insulating effect by blocking the free flow of air from the inside surface of the window. The insulating effect can be increased by sealing the side margins of the shade to the opposite upright sides of the window frame.

There have been prior attempts to form such a seal without undue interference with smooth operation of the shade. U.S. Pat. No. 2,247,634, issued Jul. 1, 1941, to Houston, for example, discloses a complicated construction including metal channels or tracks secured to the opposite upright sides of the window frame to receive the side margins of the shade (the "secondary window" in the terminology of the Houston patent). The metal channels receive "preshaped strips" of resilient material which are "snapped into place" in the channels and "remain there under tension" such that the strips "press lightly against the edge portion of the secondary window when it is between the strips" (see the paragraph beginning at the right column of page 2, line 21, of the patent).

Other constructions in which the side margins of a roll shade are captured in tracks at the sides of the window frame or a seal of the side edges of the shade to the window frame is otherwise attempted are disclosed in the following U.S. patents:

No. 2,871,933, issued Feb. 3, 1959 (Kroger);
No. 4,357,978, issued Nov. 9, 1982 (Keller et al.);
No 4,369,827, issued Jan. 25, 1983 (Anderson);
No. 4,398,585, issued Aug. 16, 1983 (Marlow);
No. 4,399,855, issued Aug. 23, 1983 (Volfson);
No. 4,408,650, issued Oct. 11, 1983 (Verch);
No. 4,499,937, issued Feb. 19, 1985 (Waine et al.);
No. 4,649,981, issued Mar. 17, 1987 (Bibeau).

Some of the devices disclosed in the above patents are hard to install, or interfere unduly with retraction of the shade, or are of complicated construction and therefore expensive.

SUMMARY OF THE INVENTION

The principal object of the present invention is to provide an improved window shade track construction to form an effective seal between the side margins of a shade of flexible sheet material and a window frame which track construction uses inexpensive components that are easy to install and do not interfere with smooth operation of the shade, and which can be used with a standard roll shade.

In accordance with the present invention, the foregoing object is accomplished by providing channels opening inward at opposite sides of the window frame and a separate one-piece sealing strip received in each channel formed of at least somewhat resilient sheet material having its opposite edge portions rolled or folded inward into abutting relationship. The side margins of the shade are received between such edge portions of the sealing strip which bear against the shade to effect the seal.

In an alternative embodiment, the channels can be wrapped with decorative material held in position by separate resilient spring clips fitted in the channels. Thereafter, the sealing strips are inserted for reception of the side margins of the shade.

BRIEF DESCRIPTION OF THE DRAWINGS

FIG. 1 is a top perspective of a frame and window construction including a conventional roll shade and the improved track construction in accordance with the present invention, with parts broken away.

FIG. 2 is an enlarged fragmentary top perspective of the track construction in accordance with the present invention showing the components of such construction in exploded relationship; and FIG. 3 a corresponding fragmentary perspective showing the components assembled.

FIG. 4 is an enlarged horizontal section along line 4—4 of FIG. 1; and FIG. 5 is a corresponding horizontal section showing a modified form of the invention.

DETAILED DESCRIPTION

Figure 6:
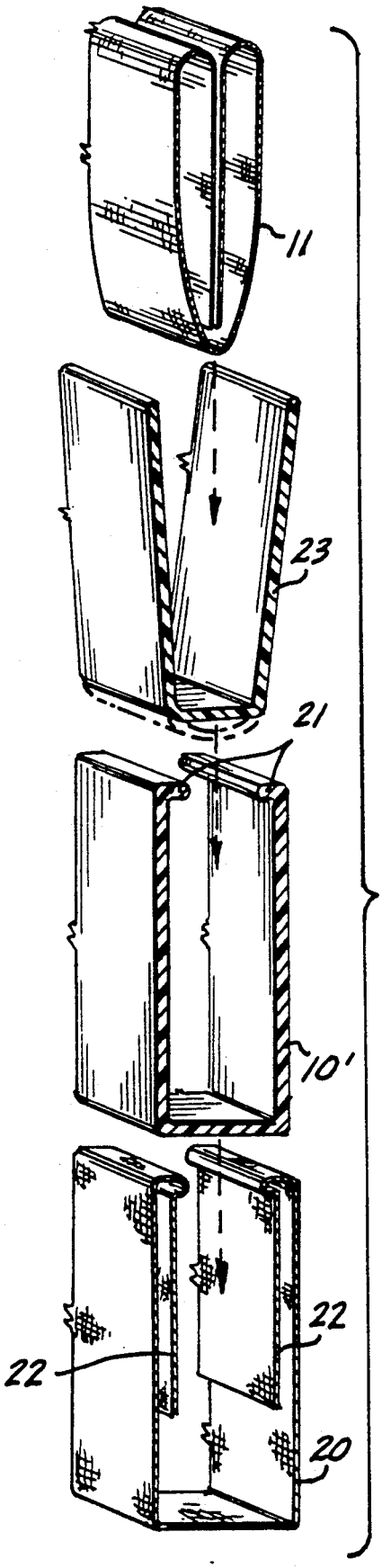
FIG. 6 is a somewhat diagrammatic fragmentary perspective of an additional embodiment of the present invention showing the components of such additional embodiment in exploded relationship.

With reference to FIG. 1, the improved track construction 1 in accordance with the present invention can be used with a conventional roll shade 2 having a sheet material body 3 wound on a roller 4. The bottom edge portion of the shade body can be hemmed with a pocket for a rigid horizontal slat. Roller 4 is conventionally mounted at the top of a window frame extending between the opposite upright surfaces 5 of such frame. In general, the track construction in accordance with the present invention includes a channel 10 secured at each side 5 of the window frame and opening toward the channel at the other side. The channels receive the side margins of the shade body 3. A separate strip of resilient sheet material is fitted in each channel to provide a seal.

With reference to FIG. 2, the channel 10 can be of any suitable material with its central groove 12 of a width greater than the maximum thickness of the body of the shade including the rigid horizontal slat at the bottom. The sealing strip 11 can be flexible acetate or plastic, preferably of a width equal to about four times the depth of the groove 12 of the channel 10. The opposite edges 13 of the strip are rolled inward to approximately its center 14 which is return bent such that the strip forms side-by-side loops with the opposite marginal portions 15 of the strip extending parallel to and close alongside each other. From the condition shown in FIG. 2, the strip can be inserted into the groove of the channel 10 such that the marginal portions 15 abut along the centerline of the channel and extend from substantially the base of the groove to the outer edge of the channel.

As seen in FIG. 4, the channel 10 can be secured to the window frame sides 5 by suitable fasteners or adhesive. Each channel extends from the sill of the window frame upward close to the roller 4. The side margins of the shade body 3 are fitted between the marginal portions 15 of the sealing strip. The natural resiliency of the sheet material sealing strip biases such portions 15 gently against the opposite surfaces of the shade to effect the desired seal. Nevertheless, the sealing strip provides only minimal interference with sliding movement of the shade in the channels 10.

In the modified embodiment shown in FIG. 5, the channel 10 mounted on each upright face 5 of the window frame can be identical to the channel of the previously described embodiment. The sealing strip 11' of such modified embodiment, however, is of a slightly heavier and less flexible sheet material such as a vinyl-coated fabric. Strip 11' is sharply folded to the condition shown in FIG. 5, as compared to strip of the previously described embodiment which is rolled. The width of strip 11' can be approximately three times the depth of the cavity 12 of channel member 10, and preferably the central portion of the strip is folded to a shape substantially complemental to the cavity 12. The opposite edge portions 15' of strip 11' are first folded inward so as to extend approximately half way into the channel. The edges 13' meet at about the center of the channel and are biased to an abutting relationship due to the natural resiliency of the strip. The margin of the shade body is received in the channel member between the marginal portions 15' which engage opposite sides of the sheet body to effect the desired seal.

As indicated in broken lines in FIG. 5, each upright edge of the shade body can be formed with an enlarged hem 16 to deter inadvertent removal of the shade from the channel.

In either embodiment, the central portion of the sealing strip encompasses substantially the entire inner periphery of the channel groove and the opposite edge portions are doubled or bent inward into the channel so as to be biased together due to the resiliency of the strip.

Figure 7:
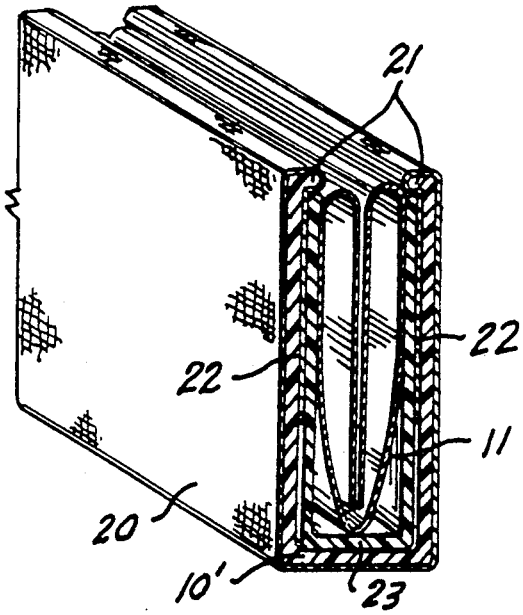
FIG. 7 is a corresponding fragmentary perspective showing the components assembled.

In the embodiment of FIGS. 1 through 4 and the embodiment of FIG. 5, the channel member is an attractive natural grain or painted wood. The modified form shown in FIGS. 6 and 7 uses a rigid channel 10', preferably plastic, which can be conveniently wrapped in an attractive fabric, such as the fabric strip 20 shown toward the bottom of FIG. 6. Channel 10' includes inward-projecting lips 21 at the top. The fabric strip 20 extends all the way around the channel and has its opposite end portions 22 extending inward into the groove of the channel. An elongated resilient spring clip 23, which also preferably is plastic, then is inserted into the channel to clamp the fabric strip 20 in position. In the relaxed condition shown in FIG. 6, such clip 23 is of generally vee configuration but with a flat bottom web corresponding to the flat bottom of the channel 10'. The bottom of such clip can be bowed to arcuate shape, as indicated diagrammatically in broken lines in FIG. 6, to allow it to be inserted into the channel between the lips 21 or the channel can be of a material allowing it to be flexed outward to receive the clip. Preferably the lips 21 are of a width approximately equal to the thickness of the clip 23 so that the inner surfaces of the opposite sides of the clip are approximately flush with the inner edges of the lips 21. Two of such composite channel members then can be installed along the upright faces of the window frame, whereupon a separate one-piece sealing strip 11 (or 11') of the type previously described is inserted into each channel for sealing engagement with the opposite side margins of the window shade.

I claim:

1. In a track construction for sealing a side margin of a roll shade to an upright side of a window frame including a channel mountable on such upright side of the window frame and having an inwardly opening central groove for receiving the side margin of the shade and sealing means fitted in such channel and resiliently biased against such side margin of the shade, the improvement comprising the sealing means including an elongated one-piece sealing strip having a central portion encompassing the inner periphery of the groove of the channel and opposite edge portions bent inward from such central portion into the groove of the channel, said strip being formed of sheet material having resiliency sufficient to bias said opposite edge portions toward each other for sealing engagement against opposite sides of the margin of the shade, said sealing strip having opposite side portions rolled inward to form side-by-side loops with said opposite edge portions of said strip extending parallel to and close alongside each other and resiliently biased toward each other.

2. In a track construction for sealing a side margin of a roll shade to an upright side of a window frame including a channel mountable on such upright side of the window frame and having an inwardly opening central groove for receiving the side margin of the shade and sealing means fitted in such channel and resiliently biased against such side margin of the shade, the improvement comprising the sealing means including an elongated one-piece sealing strip having a central portion encompassing the inner periphery of the groove of the channel and opposite edge portions bent inward from such central portion into the groove of the channel, said strip being formed of sheet material having resiliency sufficient to bias said opposite edge portions toward each other for sealing engagement against opposite sides of the margin of the shade, said opposite edge portions of said sealing strip being folded adjacent to the central portion of said strip so as to extend diagonally inward to approximately the center of the groove of the channel.

3. In the track construction defined in claim 1, the width of the one-piece sealing strip being at least about three times the depth of the channel groove.

4. In the track construction defined in claim 1, the width of the sealing strip being approximately four times the depth of the channel groove.

5. In the track construction defined in claim 2, the improvement further comprising the edge of the roll shade received in the channel having an enlarged hem for retention between the opposite edge portions of the sealing strip.

6. In a track construction for sealing a side margin of a roll shade to an upright side of a window frame including a channel mountable on such upright side of the window frame and having an inwardly opening central groove for receiving the side margin of the shade and sealing means fitted in such channel and resiliently biased against such side margin of the shade, the improvement comprising the sealing means including an elongated one-piece sealing strip having a central portion encompassing the inner periphery of the groove of the channel and opposite edge portions bent inward from such central portion into the groove of the channel, said strip being formed of sheet material having resiliency sufficient to bias said opposite edge portions toward each other for sealing engagement against opposite sides of the margin of the shade, the channel including an outer channel member, a strip of decorative fabric wrapped around said outer channel member and having opposite edge portions extending inward into the channel groove, and a resilient spring-clip fitted in said outer channel member and having opposite sides biased outward against the inner periphery of said outer channel member for clamping the opposite edge portions of said fabric strip in said outer channel member.

7. In the track construction defined in claim 6, the spring clip in relaxed condition being of approximately vee cross-section and of a maximum width greater than the maximum width of the outer channel member in relaxed condition.

8. In the track construction defined in claim 6, the outer channel member having inward extending lips hooked over the opposite edges of the spring clip.

9. In the track construction defined in claim 8, the length of each of the inward-extending lips between approximately equal to the thickness of the spring clip such that the inner surfaces of the opposite sides of the clip are approximately flush with the inner edges of the inward-projecting lips.

10. In the track construction defined in claim 6, the sealing strip having opposite side portions rolled inward to form side-by-side loops with the opposite edge portions of the strip extending parallel to and close alongside each other and resiliently biased toward each other.

11. In the track construction defined in claim 6, the width of the one-piece sealing strip being at least about three times the depth of the channel groove.

12. In the track construction defined in claim 6, the width of the sealing strip being approximately four times the depth of the channel groove.

* * * * *